US005799427A

United States Patent [19]

Abramson et al.

[11] Patent Number: 5,799,427

[45] **Date of Patent: *Sep. 1, 1998**

[54] OVERLAPPING MERCHANDISE INFORMATION DISPLAY MODULE

[75] Inventors: Patrick B. Abramson, Brampton, Canada; Peter B. Stewart, Dallas, Tex.

[73] Assignee: Vidpro International, Inc., Dallas, Tex.

[ * ] Notice: The term of this patent shall not extend beyond the expiration date of Pat. No. 5,408,775.

[21] Appl. No.: 599,561

[22] Filed: Feb. 15, 1996

[51] Int. Cl.[6] ..... G09F 3/18

[52] U.S. Cl. ..... 40/642.02; 40/651; 40/657; 248/489; 211/87.01; 211/94.02

[58] Field of Search ..... 40/642.01, 642.02, 40/657, 382, 393, 391, 651; 248/489, 476, 477, 495, 496; 211/87.01, 94.02

[56] References Cited

U.S. PATENT DOCUMENTS

| | | | |
|---|---|---|---|
| 1,710,711 | 4/1929 | Patterson | 211/87 X |
| 1,911,277 | 5/1933 | Helmer | 40/651 X |
| 2,032,533 | 3/1936 | Garfinkle | 40/651 |
| 2,824,650 | 2/1958 | Conklin et al. | 211/87 X |
| 3,121,966 | 2/1964 | Upton | 40/657 X |
| 3,142,124 | 7/1964 | Ownbey | 248/489 X |
| 4,270,290 | 6/1981 | Eckert | 40/389 |
| 4,821,437 | 4/1989 | Abramson et al. | 40/642 |
| 5,044,104 | 9/1991 | Hopperdietzel | 40/642 |
| 5,408,775 | 4/1995 | Abramson et al. | 40/642 |

FOREIGN PATENT DOCUMENTS

| | | | |
|---|---|---|---|
| 528705 | 11/1940 | United Kingdom | 40/657 |

*Primary Examiner*—Kenneth J. Dorner
*Assistant Examiner*—Andrea Chop
*Attorney, Agent, or Firm*—David H. Judson

[57] ABSTRACT

The invention relates to improvements to a merchandise information system having a plurality of overlapping display items each having on opposite sides thereof information concerning available merchandise at a remote location. The system includes a support having a rigid base, and a plurality of spaced flexible webs formed integral with the lower edge of the base and depending therefrom. The display items are attached to the lower ends of the webs to display one side of the item. The lower end of each web includes a "claw" structure to prevent theft of the display item through downward extraction of the item from the web. The rigid base connects to a hanger support ledge on a plurality of steps on a display base. Mounting of a number of supports on the steps causes the display items to be arranged in an overlapping manner.

5 Claims, 4 Drawing Sheets

OVERLAPPING MERCHANDISE INFORMATION DISPLAY MODULE

TECHNICAL FIELD

The present invention relates to merchandising systems and improvements therefor particularly adapted for displaying product information items.

BACKGROUND OF THE INVENTION

Attractive, open display of an abundance of merchandise, conducive of favorable purchasing decisions whether or not a patron is assisted by a salesperson, is potentially at odds with limiting inventory costs, reducing the amount of warehousing and other handling, controlling pilferage, and limiting losses attributable to shop worn or out-of-date merchandise. A variety of responses have occurred in response to these problems.

One direction taken has been to install an increasing number of security systems at the retail location including means of surveillance and alarm systems. This however, addresses only the problem of shrinkage attributable to pilferage and tends to create an atmosphere of distrust not conducive to customer interaction with a product which fosters a sale.

Another direction taken has been toward limiting the merchandise displayed, as for example in the number of catalog showrooms that have arisen in recent years. This tackles the problems of inventory size, handling, and losses due to out-of-date merchandise, while usually exposing only a single item to wear-and-tear or possible theft while on showroom display.

The above-identified problems have been solved through the use of merchandise information systems as described in U.S. Pat. No. 4,821,437 to Abramson, et al. The system described in that patent, which is assigned to the assignee of this application, eliminates the need for exhibition of the merchandise to the public at the retail location, but instead affords information via display of production information modules, i.e., cards, packets, or similar tactile elements of durable design and material that attractively advertise availability of the product at that outlet and inform the clientele with respect to the product. It substitutes mass display of each item carried with mass display of such information modules, in an array providing high density but individually visible display. It also substitutes physical examination of a particular sample with physical manipulation of the product information module, but without requiring a comparable level of handling by store personnel and without required dedication of a comparable amount of floor space.

In the Abramson, et al. patent, the system includes support means for holding information display means in the form of items or modules having information on front and back sides thereof in high density but individually visible concentration while allowing each and any module to be manipulated by a prospective customer for ready visual access to all the information provided thereon. The display card hanger comprise an extrusion with which the information display means is so associated that the information is readily accessible. In a preferred embodiment disclosed in the Abramson, et al. patent, the display card hanger includes flexible attachment means for permitting the manipulation of the information display means. The display card hanger can be an elongate extrusion mountable on a wall or other surface in a position to allow viewing of the information display means or product information modules. The display card hanger comprises a relatively rigid support having the flexible attachment means connected thereto. The flexible attachment means preferably comprises a plurality of flexible strips extending from the support and having free ends that terminate in attaching means adapted to grip the information display means.

One class of merchandise for which the system disclosed in U.S. Pat. No. 4,821,437 is particularly adapted is that of prerecorded video tapes. Presently tapes of concerts, motion pictures, or the like are distributed with a cassette housing provided with pictures and other labeling that identify the contents, artists, producers, and such other possible aids to selection as plot synopsis, critical acclaims, and awards. A retailer may store the cassette packages on shelves accessible to the public or maintain them behind a counter, in which case the sales impact of the labeling is substantially reduced. If offering the tapes for rent, the cassette is often removed and the housing only displayed on shelving, requiring that the housing be brought to the checkout counter and tape and housing matched. The alternative practice of openly displaying cassette and housing together, or perhaps cassette with specialized housing, requires a good deal of confidence in the store's other security measures. All of the above practices have drawbacks that are overcome by such application of time, space or restrictive practices that purveying of such tapes has been primarily limited to specialty stores.

Application of the system disclosed in the Abramson, et al. patent permits attractive displays for many different types of products including video cassettes marketed with or without cassette housings, compact disks, electronic games and general merchandise such as telephones, personal computers and their support peripherals. In the tape store application, information that went on the housing package is now placed on the product information module, employing space on the front and back of the module. A customer makes his selection at the array presented, being able to view the modules, read information contained thereon front or back by turning it on its hinge, and obtain his selection at the checkout having access to the actual cassette.

Another problem with existing systems such as Applicant's U.S. Pat. No. 5,408,775, relates to the requirement that such windows must be displayed in a side by side fashion. Displaying of these windows in some type of overlapping manner would greatly increase the amount of information that could be displayed in a small area.

While the novel merchandise system of Abramson, et al has significant advantages over the prior art, it has now been found desirable to consolidate and enhance the security of such systems to prevent theft of the information display cards.

BRIEF SUMMARY OF THE INVENTION

In accordance with one embodiment of the invention, there is provided a merchandise display system comprising a plurality of overlapping merchandise information display modules. Each overlapping merchandise information display module comprises a generally planar rectangular rigid base secured to a display wall or platform, with the base being vertically disposed. A plurality of generally parallel steps project outward from the base in a direction away from the display wall or platform, with the highest step being adjacent one edge of the base and with the other steps descending in height therefrom toward the central portion of the base. In use, the different height steps permit unobstructed, partial overlapping of display cards. Typically, the base will be attached to a display wall or platform such that the steps are oriented horizontally, but may also be oriented vertically. Each step has an outwardly projecting hanger support ledge extending along the top surface thereof. A display card hanger attaches to each hanger support ledge of the rigid base.

Each display card hanger comprises an attachment portion made from a relatively rigid material and having a web portion and upstanding portion therebehind that, together, define an upwardly open channel that is dimensioned to receive product information therein. A pair of lips extend rearwardly from the upstanding portion, which lips each terminate in a perpendicularly disposed rib. The two ribs face each other so as to be positioned to engage two opposed outwardly directed receiving surfaces of a step, thus permitting the display and hanger to be held in place on the step. A display card retaining clip is connected to the attachment portion by a flexible connecting arm, and extends downwardly therefrom. The display card retaining clip comprises front and back wall each terminating in an upwardly and inwardly angled retaining edge. A formed upper edge display card resides within the interior of the display card retaining clip, between the front and back walls and supported by the two opposed angled retaining edges, with the display card extending downwardly between the retaining edges. The flexible connecting arm permits the display card retaining clip and, therefore, the display card, to be manually rotated up to 180 degrees about an axis centered on the flexible arm from its resting position so as to permit the overlapped display cards thereunder and the back of the raised card to be viewed by a user.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
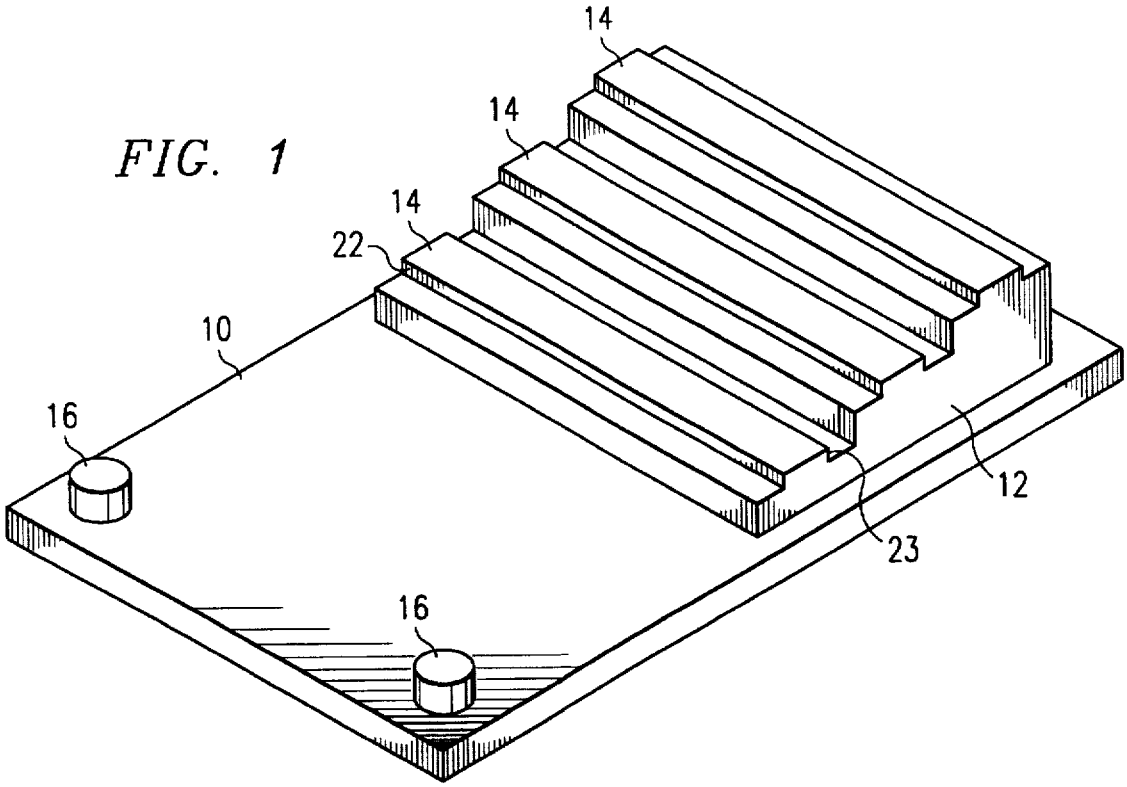
FIG. 1 is a perspective view of a base of an overlapping merchandise information lay.
Figure 2:
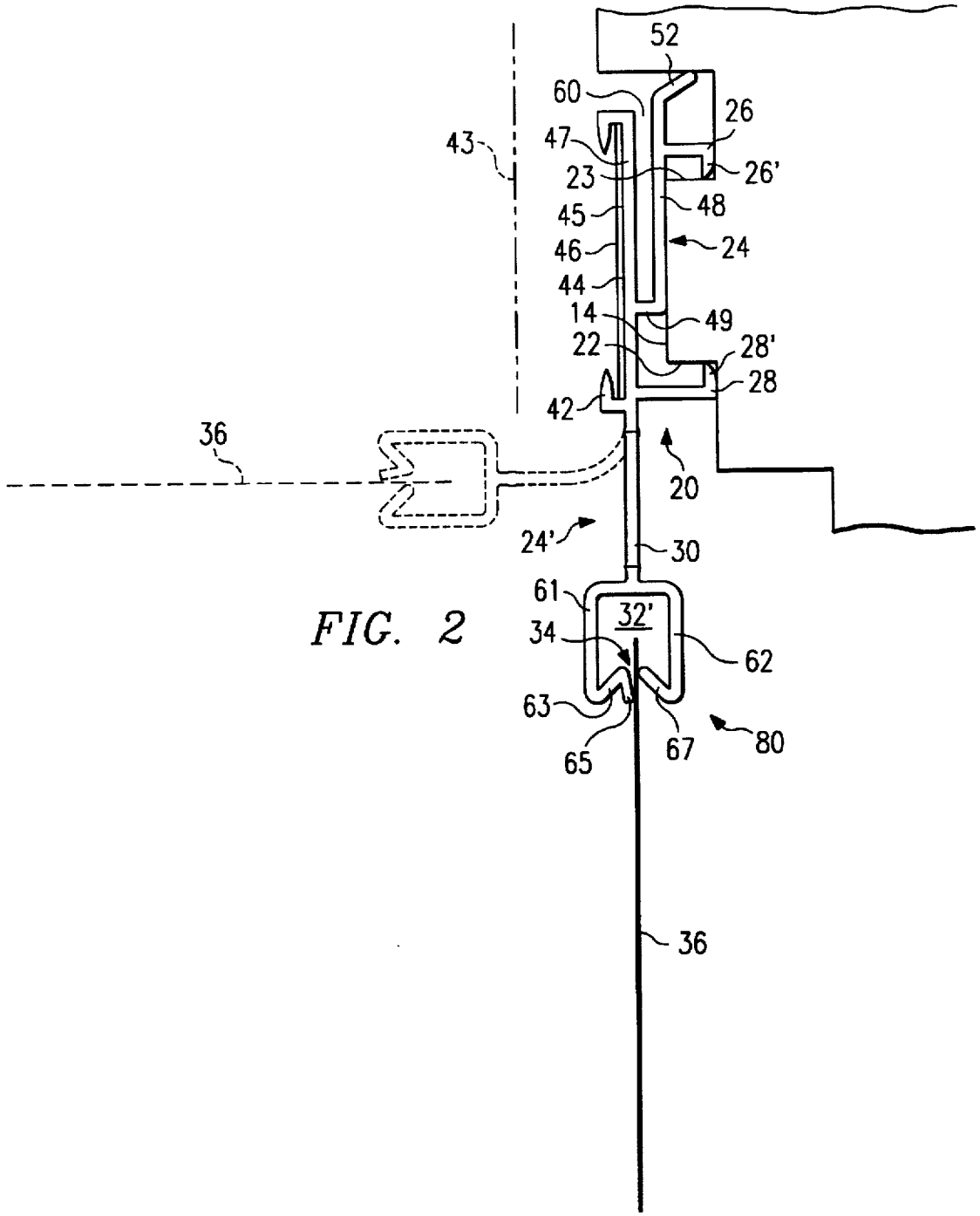
FIG. 2 is an end view of the overlapping merchandise information display module.

Reference is now made to FIGS. 1 and 2 which illustrate the overlapping merchandise information display of the present invention. A base 10 consists of a plurality of steps 1 2 on the upper portion of the base. A hanger support ledge 14 runs along the center of each step to which a display card hanger 20 of the overlapping display is attached. Leveling posts 16 below the plurality of steps 12 support the lower most display window 21 of the overlapping display such that the display window will lay substantially parallel to the lowest step. The hanger support ledge 14 has upper and lower faces 22 and 23, respectively, onto which the lips 26 and 28 of the display card hanger 20 are snapped or slid. Additionally some type of bonding agent or glue may be used to secure the display card hanger 20 to the hanger support ledge 14. The display card hanger 20 is of relatively complex cross-section, being extruded into such form and having different portions 24, 24' and 24" possessing different mechanical properties for reasons which will be explained hereinafter.

The portion 24 includes the upper and lower flanges 26 and 28 having the aforesaid ribs 26' and 28' which are received on faces 22 and 23. The flanges are spaced apart so as respectively to fit over the faces 22 and 23 of the hanger support ledge 14. The portion 24 is made of relatively rigid plastic or synthetic resinous material and is extruded integrally with the portion 24' which is relatively flexible and is in turn extruded integrally with the display card retaining clip 24". The display card retaining clip 24" is less flexible than the portion 24' but more flexible than the portion 24.

The portion 24 forms an elongate support for an array of the product information display means 36 so that a prospective customer may view the information on the front side of each item attached to the support 24. Each display means is capable of being manipulated by swinging it upwardly as indicated by the arrow A to the dotted line position 43, the information on the reverse side of the means 36 then being accessible to the prospective customer. The flexible attachment means provided by the portions 24' permit this manipulation. It will be noted that portion 24' comprises a flexible member 30 in the form of a web.

The free ends of the display and retaining clip 24" are formed into "claw-like" clips 32 of rectangular cross sections provided by the slots 34 extending the length of each clip 32. Each clip 32 includes first and second sides 61 and 62. Side 61, located away from the support wall, has an upwardly-extending retaining edge 63 that terminates in a downwardly-extending alignment lip 65. Alignment lip 65 presses against the face of the display item to insure that all of the display items lay with substantially the same orientation. Side 62 has an upwardly-extending retaining edge 67 that corresponds to the edge 63 of the side 61. The edges 63 and 67 extend upwardly to form the slot 34 and advantageously prevent the packet from being removed from the system through a downward pull. When the clip 32 is used, the packet can only be removed by sliding it out lengthwise of clip 32.

Each product information display means 36 is of generally rectangular configuration and comprises a graphics card 37 or two such graphics cards or sheets which provide all the requisite information about a particular piece of merchandise, which graphics cards are enclosed or encased in the clear plastic envelope 39'. The side or fact of the display means 36 which is normally exposed to the customer's view will usually be provided with the title and an attractive picture and the reverse side of the display means facing the wall will usually be provided with more detailed information about the corresponding merchandise. The plastic envelope 39 can be sealed to provide the information display means in packet form.

In FIG. 2, it will be appreciated that, because each information display means 36 is swung upwardly such as indicated by reference character 43, information on the back of the packet will have to lie head to toe to that on the front of the label to permit it to be easily read. Also, it will be noted that when the packet is released, it will simply fall to the original position as shown by the central display means 36 in FIG. 2. If for any reason a particular display means 36 must be replaced, same may be done by sliding it out lengthwise of the clip 32. Another display means 36 may then be slid or snapped into the clip 32, and thus may the product information display means 36 be replaced or rearranged at will.

In order to assemble the display system, the base 10 is placed at a location such that when the display means 36 are mounted, each such means overlap and can be freely raised to view its reverse side and the display it. Once the base 10 has been set and secured, the display card hanger 20 is cut to size and put into place. By connecting the display card hanger 20 to the hanger support ledges 14 of the successive steps 12 of the base 10, a number of display means 36 are able to be presented in an overlapping manner. By raising the top display means 36, the display means below it is able to be viewed and in a subsequent manner, each of the following display means may be raised to view the display means beneath it. In this manner, a much greater number of display means 36 are presented in a smaller area. A plurality of support posts 16 below the steps 12, enable the overlapping display means to be maintained in a substantially parallel fashion. The display means 36 can next be sorted and arranged and then inserted into their appropriate positions by use of the claw-like clips 32. Finally, other labeling or indicia 46 may be applied to the surface 45.

The front side of the elongate support 24 is provided with two forwardly projecting and mutually convergent ribs, 40 and 42, that define, with the front face 45, a wide shallow channel 44 extending the length of the display card hanger 20 and within which labels such as indicated at 46 can be placed to contain further information such as identification of the product advertised by a corresponding display means 36.

Still referring to FIGS. 1 and 2, the upstanding portion 48 is joined to the web 47 by the bight 49 to define an upwardly opening channel 60, said channel being dimensioned so that additional product information means 36 or other ancillary display information may be inserted thereinto. The ramp 52 projects upwardly and rearwardly from the upper edge of the portion 48 to assure easy insertion of such elements into the channel 60.

Various modifications may be made to the embodiments described. The invention may be practiced in display, information, or exhibit contexts other than a retail outlet. Orientations other than horizontal may be employed. Surfaces to which the system is attached may have fixed, moveable, or other characteristics.

Figure 3:
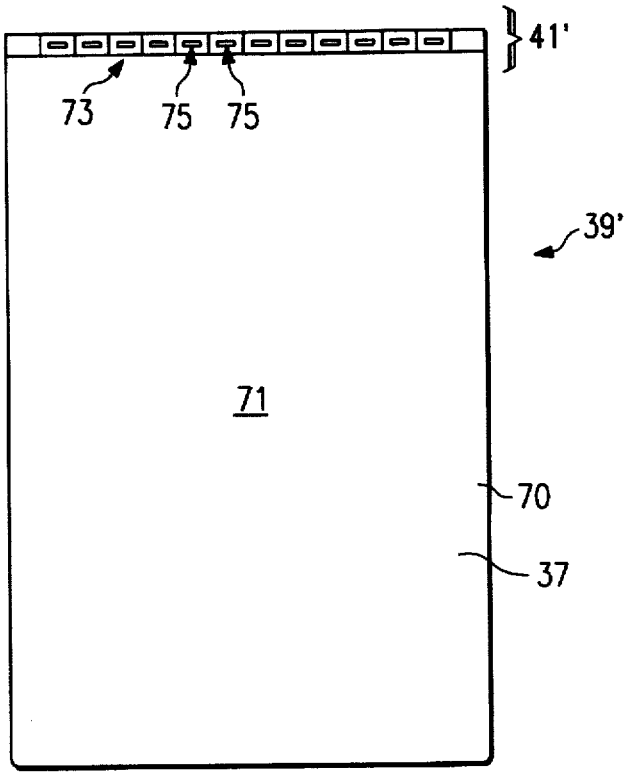
FIG. 3 is an elevation view of the individual product information display means according to the present invention.
Figure 4:
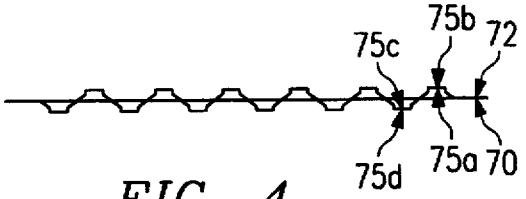
FIG. 4 is a plan view of the display means of FIG. 3.

Referring now to FIGS. 3 and 4, each of the information display means 36 may alternatively comprise a plastic envelope 39' that, rather than being sealed, is formed of two sheets 70 and 72 sealed around their bottom and side edges to form a pocket 71 within the envelope. The pocket supports the graphics card 37 as previously described. With this construction, the graphics card 37 can be readily exchanged by the store personnel to increase the flexibility of the system. Each of the sheets 70 and 72 has a crimped upper edge 73 comprising a plurality of inwardly- and outwardly-directed projections 75. After the graphics card is inserted, the upper edges of each of the sheets 70 and 72 are pressed together to seal the packet. In particular, the first inwardly-directed projection **75*a* of sheet 70 mates with the corresponding outwardly-directed projection 75*b* of sheet 72, the first inwardly-directed projection 75*c* of sheet 72 mates with the corresponding outwardly-directed projection 75*d* of sheet 70, and so forth. The bead 41' of the plastic envelope 39'** thus has an alternating crimped configuration, which enhances the ease with which the individual packets can be stacked on top of each other for storage and shipment.

Figure 5:
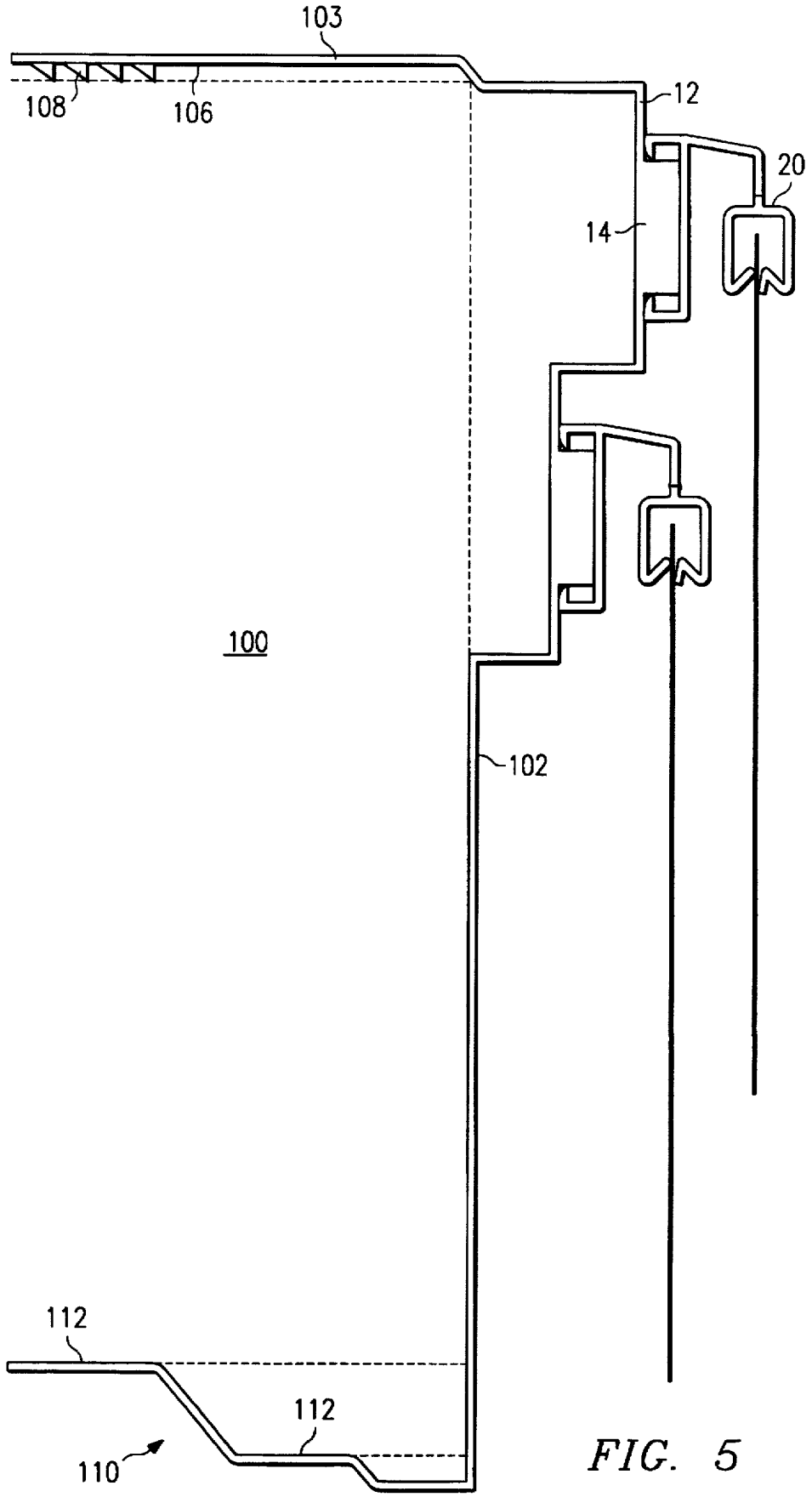
FIG. 5 is an end view of an alternative embodiment of the base of the overlapping merchandise information display module.

Referring now to FIG. 5, there is illustrated an alternative embodiment of the overlapping information display module. The base 10 is constructed to fit as a sleeve over a beam 100. The front wall 102 of the base 10 is a planar surface similar to that discussed with respect to FIG. 1 having a plurality of raised steps 12 rising therefrom. Along the top surface of each step is a hanger support ledge 14 for supporting a display card hanger 20 in the same manner as that discussed previously. The display card hangers 20, hanger support ledge 14 and raised steps 12 will be identical to those discussed in the previous embodiment. While FIG. 5 is illustrated showing only two raised steps, it should be understood that any number of steps capable of fitting along the surface of front wall 102 would be acceptable.

A top wall 103 extends perpendicularly from the edge of front wall 102. On the bottom surface 106 of top wall 113 are a plurality of friction teeth 108 for engaging and gripping the top surface of a beam 100. The teeth 108 comprise angular protrusions which taper from the bottom surface of top wall 112 to an end point for engaging the beam 100. A bottom wall 110 comprises a multilevel surface defining one or more contact levels 112 for engaging the bottom of a beam 100. The embodiment of FIG. 5 discloses a bottom wall 1 10 capable of engaging beams of two different thicknesses but additional contact levels would be possible.

Figure 6:
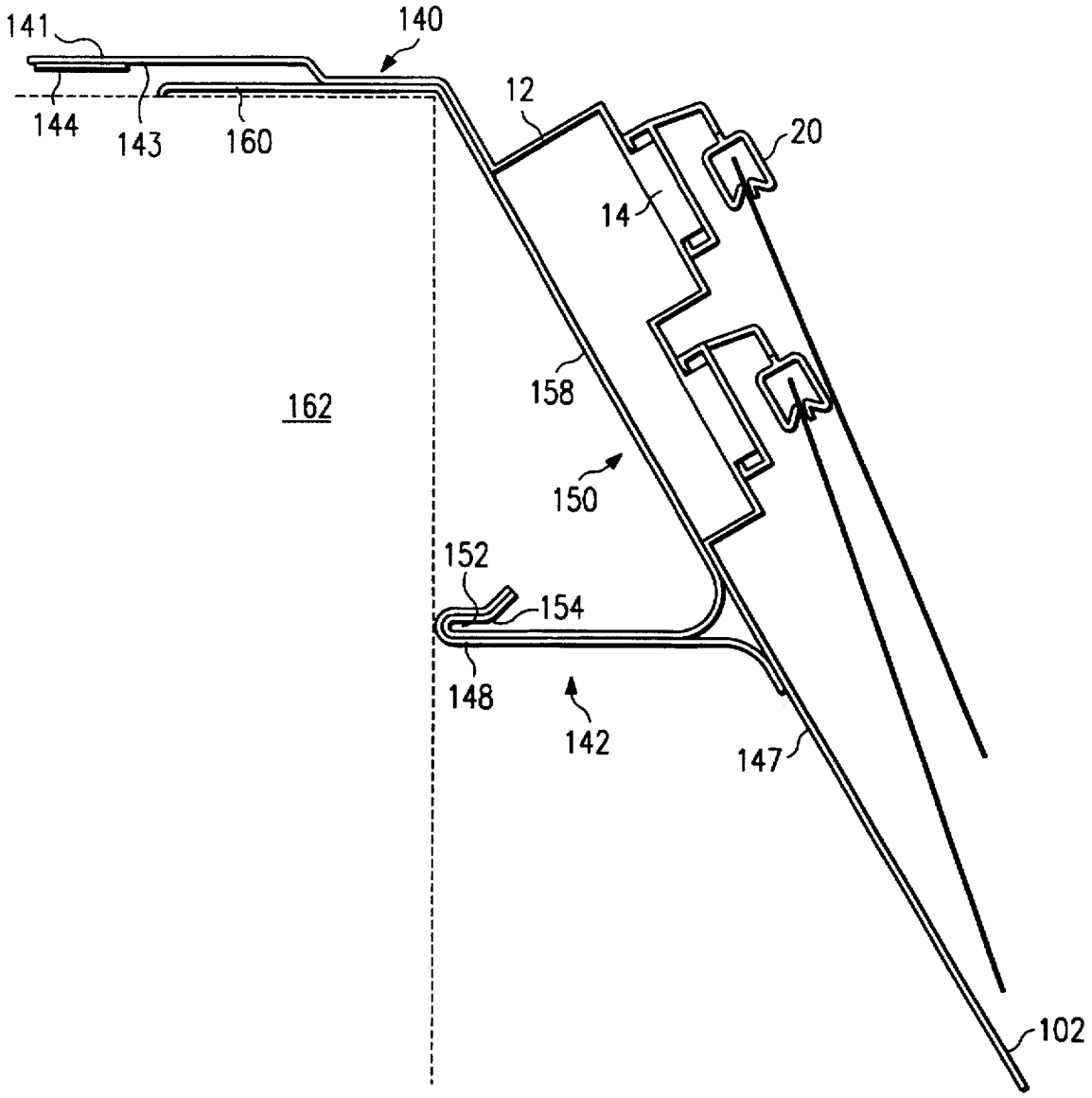
FIG. 6 is an end view of an alternative embodiment of the base of the overlapping merchandise information display module.

Referring now to FIG. 6, there is illustrated yet another embodiment of the present invention. The embodiment of FIG. 5 illustrates an overlapping merchandise display module configured to angle outward from the shelf on which the module is supported to provide easier access to a user. The front wall 102 of base 10, raised steps 12, hanger support ledge 14 and display card hangers 20 are identical in structure and function to those previously discussed with respect to the other embodiments. The base 10 differs in the inclusions of a top support wall 140 and mounting structure 142 that enable the base to extend outward from a shelf 162.

The top support wall 140 connects and extends outward from the front wall 102 of the base at an angle of approximately 60 degrees. However, it should be realized that any angle that provides user access to the display would be acceptable. The majority of the top support wall 140 includes a raised portion 141 rising slightly above the level at which the wall connects with the front wall 102 to accommodate shelves with rough or uneven surfaces.

The support structure consists of magnetic tape 144, bracket clip 148 and bracket 150. The magnetic tape 144 is connected to the bottom side 143 of the top support wall 140 to secure the end of the top support wall to a metal shelf. Alternatively, any other means capable of securing the top support wall to a shelf would be acceptable for shelves of differing materials. From the back side 147 of the front wall 102 extends bracket clip 148 for securing bracket 150 to the back surface of the base 10. The bracket clip 148 defines a hook-shaped slot 152 for receiving a hooked shaped end 154 of bracket 150. Bracket 150 snaps into bracket clip 148 and provides support to the back side of front wall 102 with plate 158 and to the back side top of wall 140 with plate 160. The bracket clip 148 also acts as a support arm against an edge of a shelf 162 for the front wall 102 when the base 10 is mounted to the shelf as shown.

It should be appreciated by those skilled in the art that the specific embodiments disclosed above may be readily utilized as a basis for modifying or designed other structures for carrying out the same purposes of the present invention. It should also be realized by those skilled in the art that such equivalent constructions do not depart from the spirit and scope of the invention as set forth in the appended claims.

What is claimed is:

1. A merchandise display system for displaying a plurality of overlapping display items, comprising:

a base a plurality of steps connected to the base;

a plurality of hanger support ledges running along a top surface of each of the steps;

means for supporting lower edges of the plurality of overlapping display items; and a plurality of display card hangers, each comprising:

a first portion of relatively rigid material having means therein for mounting the display card hanger to the hanger support ledges;

a second portion comprising a flexible web; and attaching means connected to a lower edge of the flexible web for attaching a display item thereto in a depending relationship therefrom so that one side of the display item is visible to a customer, the attaching means further including means for preventing the display item from being pulled out therefrom in a predetermined direction, and wherein the means for preventing the attaching means includes first and second sides, each having an upwardly and inwardly directed edge, the upwardly and inwardly directed edge of the first side further including an outwardly extending alignment lip to maintain the display item in a predetermined orientation.

2. The merchandise display system of claim 1 wherein the means for supporting is capable of maintaining the display items in a substantially parallel orientation.

3. A merchandise display system comprising:

a base;

a plurality of steps connected to the base;

a plurality of hanger support ledges running along a top surface of each of the steps; and a plurality of display card hangers for mounting display items to the hanger support ledges of the steps in an overlapping arrangement relative to one another such that each display item may be manipulated by a customer to provide ready visual access to all information on opposite sides of the display item and to all information on a top side of an immediately following display item;

wherein the base further includes means for supporting lower edges of the display items.

4. The merchandise display system of Claim 3 wherein the means for supporting is capable of maintaining the display items in a substantially parallel orientation.

5. A merchandise display system comprising:

a base;

a plurality of steps connected to the base;

a plurality of hanger support ledges running along a top surface of each of the steps; and a plurality of display card hangers for mounting display items to the hanger support ledges of the steps in an overlapping arrangement relative to one another such that each display item may be manipulated by a customer to provide ready visual access to all information on opposite sides of the display item and to all information on a top side of an immediately following display item;

wherein each display card hanger further comprises:

a first portion of relatively rigid material having means therein for mounting the display card hanger to the hanger support ledges;

a second portion comprising a flexible web; and attaching means connected to a lower edge of the flexible web for attaching the display item thereto in a depending relationship therefrom so that one side of the display item is visible to a customer, the attaching means further including means for preventing the display item from being pulled out therefrom in a predetermined direction, and wherein the means for preventing of the attaching means includes first and second sides, each having an upwardly and inwardly directed edge, the upwardly and inwardly directed edge of the first side further including an outwardly extending alignment lip to maintain the display item in a predetermined orientation.

* * * * *